US005868459A

United States Patent [19]

Welsh, Jr.

[11] Patent Number: 5,868,459

[45] Date of Patent: Feb. 9, 1999

[54] BOUNCER WITH POSITIVE LOCK

[75] Inventor: Thomas J. Welsh, Jr., Naperville, Ill.

[73] Assignee: Kolcraft Enterprises, Inc., Chicago, Ill.

[21] Appl. No.: 833,924

[22] Filed: Apr. 10, 1997

[51] Int. Cl.[6] ..... A47D 13/10

[52] U.S. Cl. ..... 297/32; 297/258.1; 297/16.1; 403/102

[58] Field of Search ..... 297/16.1, 258.1, 297/377, 55, 32; 403/102

[56] References Cited

U.S. PATENT DOCUMENTS

| | | | |
|---|---|---|---|
| 1,366,274 | 1/1921 | Orth | 297/377 |
| 2,848,040 | 8/1958 | Chernivsky . | |
| 2,988,136 | 6/1961 | Kowalczyk . | |
| 3,017,220 | 1/1962 | Chernivsky | 297/390 |
| 3,071,413 | 1/1963 | Flint et al. | 297/456 |
| 3,110,519 | 11/1963 | Chernivsky | 297/285 |
| 3,161,973 | 12/1964 | Hastings | 403/102 S |
| 3,235,306 | 2/1966 | Chernivsky | 297/296 |
| 3,563,592 | 2/1971 | Preston | 403/102 X |
| 3,656,808 | 4/1972 | Chang | 297/445 |
| 4,062,589 | 12/1977 | Klein et al. | 297/450 |
| 4,141,590 | 2/1979 | Lafer | 297/440 |
| 4,339,488 | 7/1982 | Brokmann | 428/100 |
| 4,553,786 | 11/1985 | Lockett, III et al. | 297/440 |
| 4,958,885 | 9/1990 | Kassai | 297/16.1 X |
| 5,577,799 | 11/1996 | St. Germain | 403/102 X |

*Primary Examiner*—Peter R. Brown

*Attorney, Agent, or Firm*—Marshall, O'Toole, Gerstein, Murray & Borun

[57] ABSTRACT

A bouncer device having a base frame and infant seat frame pivotally connected to each other and held in an erected position by a pivot arm assembly which includes a movable locking sleeve which precludes a pivot arm assembly from collapsing.

4 Claims, 2 Drawing Sheets

BOUNCER WITH POSITIVE LOCK

FIELD OF INVENTION

The invention disclosed and claimed herein relates generally to a rocker apparatus for infants, and more particularly, the invention relates to a collapsible infant rocker device which can be readily erected and maintained in a use position by a slip lock.

DESCRIPTION OF THE PRIOR ART

There are presently available in the art various infant rocker devices in which an infant is seated. The device either can be placed in a rock mode where the infant is rocked back and forth, or the device simply can be used to hold the infant with the rocker maintained in a stationary mode. Rocker devices are somewhat bulky which presents a problem when one attempts to store the rocker when it is not in use or when it is necessary to transport the rocker from one location to another. While rocker devices are known which can be disassembled to place the rocker in a collapsed position, unfortunately, it is sometimes relatively difficult to disassemble the rocker device.

What is desired is to have an infant rocker device which can be readily erected for use or collapsed for storage and transport purposes. Moreover, it is desired to have a rocker device which, when placed in an erected position, the bouncer unit will not collapse inadvertently.

SUMMARY OF THE INVENTION

The invention disclosed and claimed herein serves to obviate the problems associated with prior art rocker devices while at the same time achieving the desired features for an infant rocker device.

Briefly, the infant rocker device of the present invention utilizes a frame assembly comprising a U-shaped base frame which is adapted to be located on a floor or other surface. A U-shaped infant seat frame is pivotally connected to the base frame whereby the two frames are adapted to pivot relative to each other at their open ends. A conventional fabric panel is attached to and extends substantially along the length of the infant seat frame.

Two pivot arm assemblies located on the sides of the rocker serve to hold the infant support frame in a spaced position from the base frame when the rocker is in an erected position. Each pivot arm assembly includes two pivot link members each having two ends. One link member has one end pivotally fastened to the base support frame while the other pivot link member has one end pivotally connected to the infant seat frame. The remaining pivot link ends are pivotally connected to each other via a bracket. A movable locking sleeve is disposed on each pivot arm assembly. The sleeve is dimensioned and configured to easily slide along a link member. When the rocker device is in an erected position, the locking sleeves are disposed over the pivot joints of the pivot arm assemblies thereby precluding the rocker device from collapsing.

To collapse the rocker device, one need only pull the locking sleeve away from a pivot joint on each assembly, whereupon the pivot link members can pivot relative to one another and the infant seat frame and base frame collapse toward one another to form a compact unit which can be relatively easily stored or transported.

DETAILED DESCRIPTION

Figure 1:
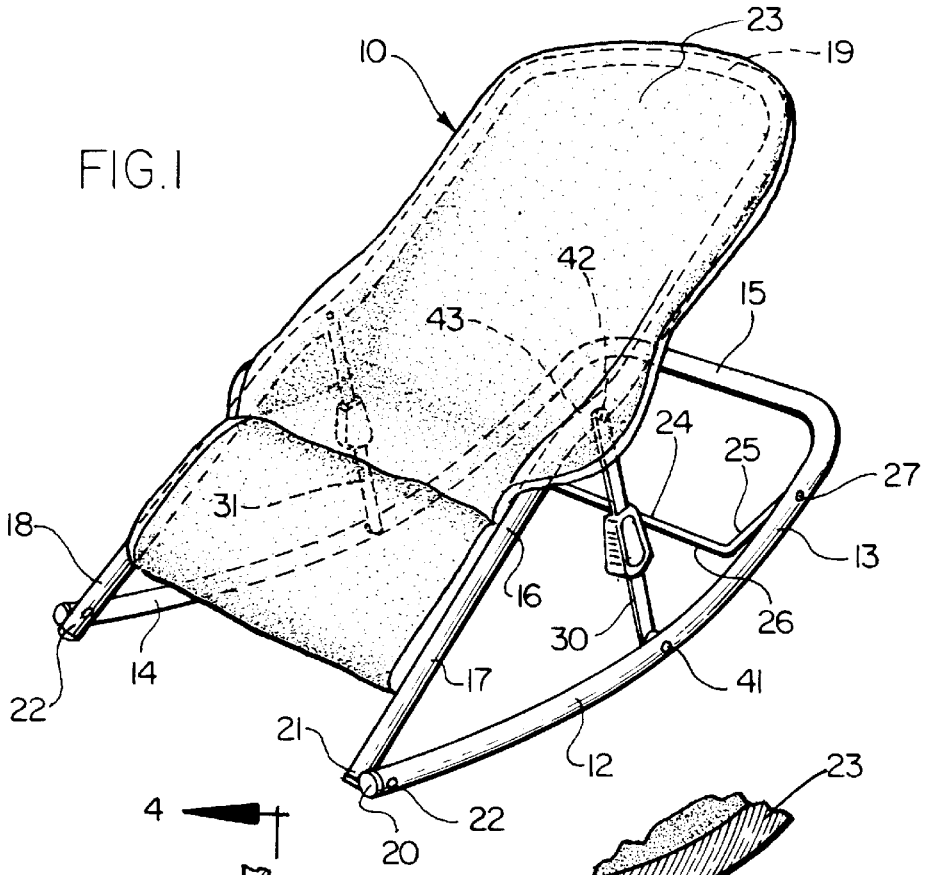
FIG. 1 shows a perspective view of an infant rocker device in an erected position.

Referring to the drawings, FIG. 1 shows infant rocker device 10. The rocker comprises a U-shaped base frame 12 having curved rocker legs 13, 14, and end leg 15. Infant seat frame 16 includes two side frame members 17, 18 which extend from curved frame end member 19. The open end 20 of base frame 12 is pivotally connected to the open end 21 of infant seat frame 16 at 22.

A fabric seat panel 23 is attached to frame 16 at the location of the frame side members 17, 18 and frame end member 19. The fabric panel is made from a conventional rock seat panel material and is adapted to hold an infant seated or lying in panel 23 which extends along the substantial length of the frame member.

Figure 7:
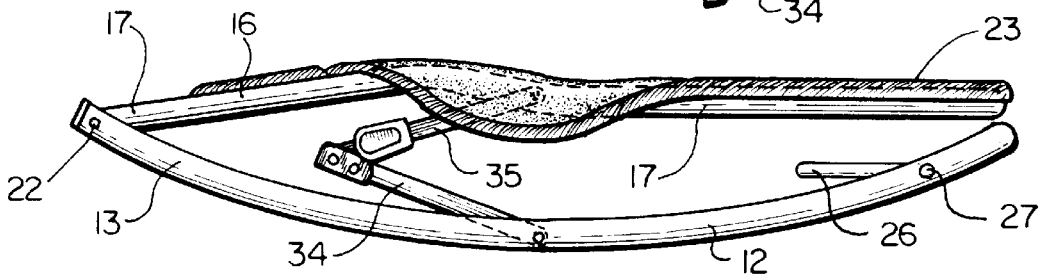

A conventional U-shaped lock member 26 comprising base 24 and two side legs 25 is pivotally connected at 27 to base frame 12 and can be maintained, if desired, in the position shown in FIG. 1 or a folded position as illustrated in FIG. 7. When lock member 26 is in the position shown in FIG. 1, the rocker will be in a non-rock position. When member 26 is pivoted to the position shown in FIG. 7, base frame 12 and device 10 will be in a rock mode.

Pivot arm assembly 30 is pivotally connected to base leg 13 and frame side member 17, while pivot assembly 31 is pivotally connected to base leg 14 and frame side member 18. The construction of each pivot arm assembly is identical and accordingly, it is necessary only to describe one of the pivot arm assemblies.

Figure 5:
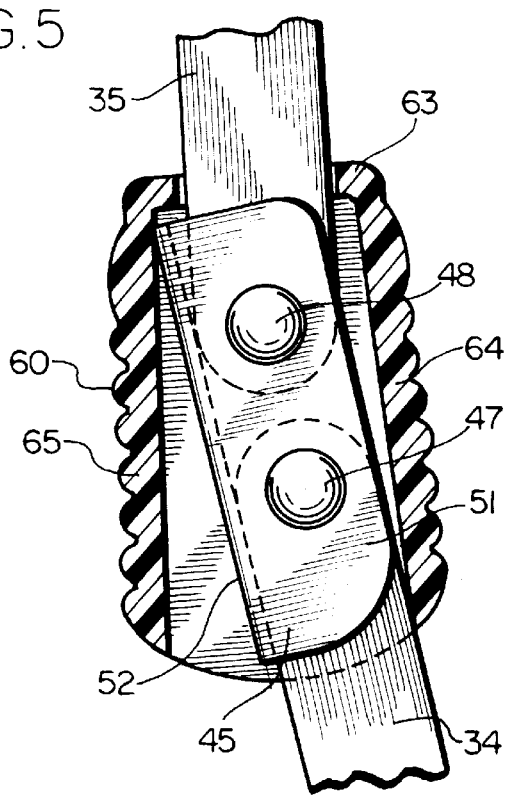
FIG. 5 shows the pivot joint of FIG. 4 precluded from movement by a locking sleeve.

Assembly 30 comprises two pivot link members 34, 35. Link member 34 has one end 40 pivotally connected at 41 to base leg 18. Link member 35 has one end 42 pivotally connected at 43 to frame side member 17. The remaining end 44 of link member 34 is pivotally connected at 47 to link bracket 45. Similarly, the remaining end 46 of link member 35 is pivotally connected at 48 to link bracket 45. Viewing FIG. 5, it will be observed that each link member 34, 35 will pivot relative to link bracket 45. Bracket 45 comprises a U-shaped member and includes two side members 50, 51 and base member 52.

Figure 3:
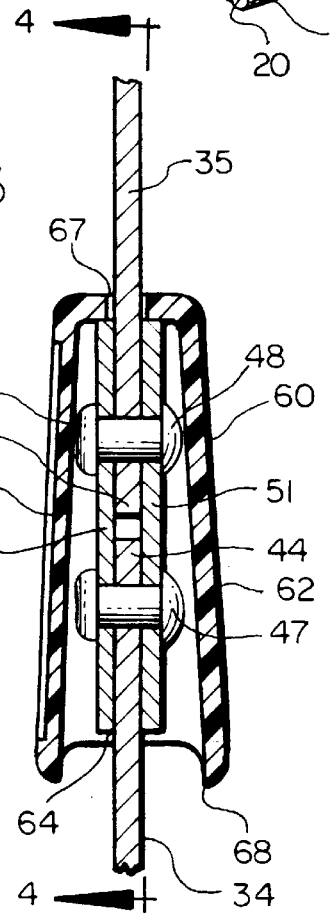
FIG. 3 shows a section view taken along lines 3—3 in FIG. 2.

Flexible sleeve 60 is disposed on each pivot link assembly 30, 31. Sleeve 60 preferably is a rectangular-shaped plastic member comprising side walls 62, 63 spaced by end walls 64 and 65. Sleeve top wall 66 is slotted at 67 while the opposite bottom end 68 of sleeve 60 is open. As illustrated in FIG. 3, side walls 62, 63 are tapered outwardly proceeding from end wall 66 to open bottom end 68.

Figure 2:
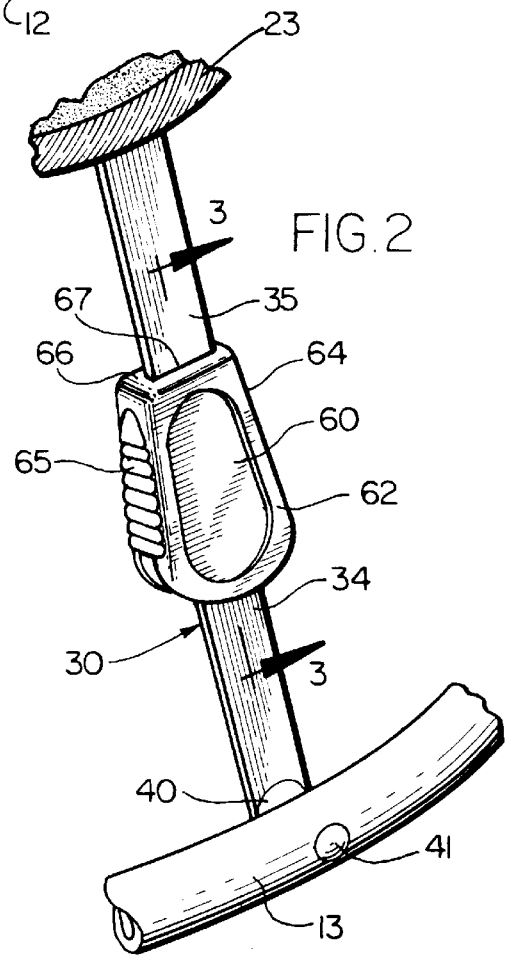
FIG. 2 shows a fragmentary perspective view of a pivot arm assembly of the present invention with a locking sleeve positioned over a pivot joint.
Figure 6:
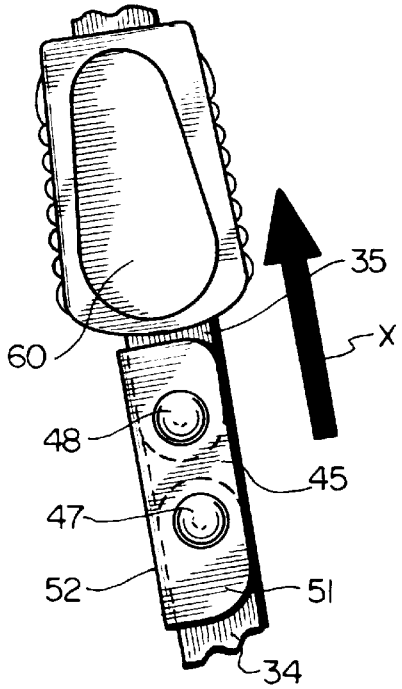
FIG. 6 shows the locking sleeve of FIG. 2 moved away from the pivot joint; and, FIG. 7 shows the infant rocker device of FIG. 1 in a collapsed position.

It will be observed upon viewing FIGS. 1 and 6, for example, that sleeve 60 is adapted to slide along the length of pivot link member 35 in the direction of arrow X from the position shown in FIG. 2 to the position shown in FIG. 6. When sleeve 60 is in the position shown in FIG. 2, the sleeve serves to lock pivot link assembly 30 so that link members 34, 35 are precluded from pivoting at their respective ends 44, 45. When sleeve 60 travels along link member 35 in the direction of arrow X to the position shown in FIG. 6, link members 35 then are adapted to pivot relative to each other and bracket 45.

Figure 4:
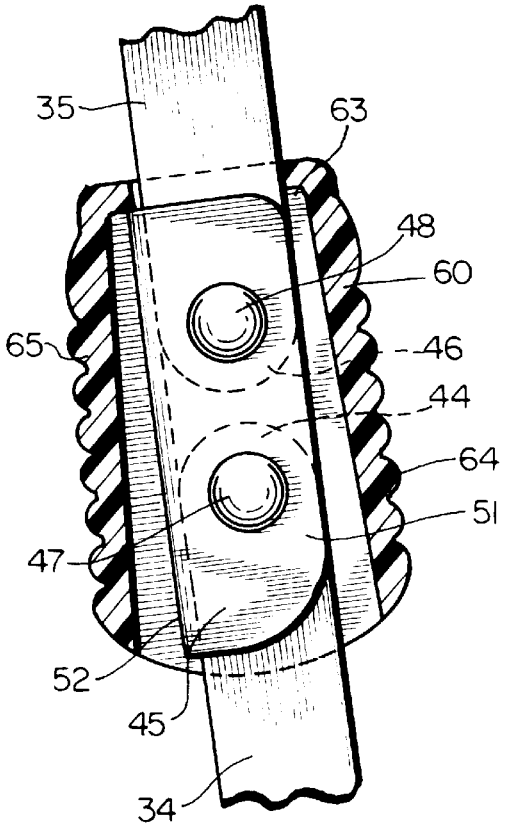
FIG. 4 shows a section view taken along lines 4—4 in FIG. 3.

In operation, when it is desired to erect rocker 10, infant seat frame 16 is pivoted relative to base frame 12 to the position illustrated in FIG. 1. While manually retaining sleeve 60 away from bracket 45 (see FIG. 6), the pivot link members 34, 35 of pivot arm assemblies 30, 31 move to their respective positions illustrated in FIG. 4. Sleeve 60 then is permitted to drop or is otherwise directed downwardly from the sleeve position of FIG. 6 to the sleeve position shown in FIG. 2 so that it positively locks the link members from inadvertently collapsing. It will be observed, that when sleeve 60 is in a locked position, the sleeve encloses clip bracket 45 and pivot members 47, 48. With the device of the present invention, rocker device 10 can be readily and relatively easily erected or collapsed.

While any suitable means can be used to provide the various pivot joints, conventional rivet members used with rocker devices are satisfactory.

Similarly, although two pivot arm assemblies are illustrated with the bouncer unit, it is appreciated a device could be utilized in which only one pivot link assembly is utilized.

While the present invention has been described in connection with a single embodiment, it will be understood to those skilled in the art that many changes and modifications may be made without departing from the true spirit and scope of the invention. It is therefore intended by the appended claims to cover all such changes and modifications which come within the true spirit and scope of the invention.

What is claimed is:

1. An infant seat device, said device comprising:

a U-shaped base frame including an end leg and two base legs, said end leg connecting to said base legs at one of two ends of each base leg;

a seat frame having two spaced legs and an end frame member, said member being connected to one of two ends of each frame leg;

said seat frame and base frame being hingedly connected to one another at said second end of each base leg and frame leg;

at least one pivot link assembly connecting said base frame to said seat frame, said assembly comprising two pivot link members, each pivot member having two ends;

the first end of one pivot link member being hingedly connected to a base frame side leg and the first end of said remaining pivot member being hingedly connected to a seat frame side leg;

a bracket member having a length, width and thickness hingedly connected to each of said pivot link members at their respective second ends;

an open-ended sleeve adapted to seat over said bracket member and including a pair of side members, each side member having first and second ends, a top member connecting one end of each said side members, said top member including a slot whose width is less than said bracket width whereby, to lock said pivot link assembly, said sleeve travels along the length of said pivot link assembly until said sleeve top member seats on an end of said bracket whereby said sleeve encloses and locks said pivot members; and, to unlock said pivot link assembly, one raises said sleeve upwardly away from said hinged bracket member whereby said pivot link members can collapse relative to said bracket member.

2. A device in accordance with claim 1 wherein said sleeve is formed of plastic.

3. A device in accordance with claim 2 wherein said sleeve tapers outwardly from said top member to said open sleeve end.

4. A device in accordance with claim 1 and including a second pivot link assembly hingedly connecting said remaining base side leg and seat frame side leg and a second open-ended sleeve identical to said first sleeve being disposed on said second pivot link assembly.

* * * * *